US006213435B1

(12) United States Patent
Minet

(10) Patent No.: US 6,213,435 B1
(45) **Date of Patent: *Apr. 10, 2001**

(54) AUXILIARY DEVICE FOR BED-RIDDEN AND DISABLED PATIENTS

(75) Inventor: Wilhelm Minet, Forchheim (DE)

(73) Assignee: Dipl.-Ing. Klaus Haken, Erlangen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/372,111

(22) Filed: Aug. 11, 1999

Related U.S. Application Data

(63) Continuation of application No. 08/841,459, filed on Apr. 22, 1997, now Pat. No. 6,039,293.

(30) Foreign Application Priority Data

Apr. 23, 1996 (DE) ..... 296 07 345 U
Dec. 21, 1996 (DE) ..... 296 22 131 U

(51) Int. Cl.[7] ..... A47F 5/00

(52) U.S. Cl. ..... 248/125.8; 5/81.1; 5/662; 248/188.5

(58) Field of Search ..... 248/125.8, 188.5, 248/200.1, 161, 158, 354.5; 5/662, 81.1, 84.1, 658, 663

(56) References Cited

U.S. PATENT DOCUMENTS

| | | | | |
|---|---|---|---|---|
| 247,403 | | 9/1881 | Pistorius . | |
| 269,570 | | 12/1882 | Goodwin . | |
| 321,388 | | 6/1885 | Ruebsam . | |
| 649,901 | * | 5/1900 | Brennan | 248/125.8 |
| 755,699 | | 3/1904 | Robertson . | |
| 1,269,734 | | 6/1918 | Noland . | |
| 1,295,753 | | 2/1919 | Hoyer . | |
| 1,996,052 | | 4/1935 | Allaire et al. . | |
| 2,079,617 | | 5/1937 | Johnson . | |
| 2,259,757 | | 10/1941 | Longfellow . | |
| 2,981,959 | | 5/1961 | Burnham . | |
| 2,994,501 | | 8/1961 | Barnard . | |
| 3,077,613 | | 2/1963 | Mayer . | |
| 3,099,842 | | 8/1963 | Jensen . | |
| 3,286,283 | | 11/1966 | Bertoldo . | |
| 3,310,817 | | 3/1967 | Harding . | |
| 3,604,019 | | 9/1971 | Garner . | |
| 3,850,165 | | 11/1974 | Throner . | |
| 3,875,356 | | 4/1975 | Heim et al. . | |
| 3,911,509 | | 10/1975 | Fleckenstein . | |
| 4,524,475 | | 6/1985 | Valentino . | |
| 4,706,915 | * | 11/1987 | Cindric et al. | 248/125.8 |
| 4,725,027 | * | 2/1988 | Bekanich | 248/125.8 |
| 4,932,090 | | 6/1990 | Johansson . | |
| 5,231,721 | | 8/1993 | Fish . | |
| 5,470,037 | * | 11/1995 | Willis | 248/125.8 |
| 5,507,044 | | 4/1996 | Williamson et al. . | |
| 5,524,303 | | 6/1996 | Palmer, Jr. et al. . | |
| 5,527,016 | * | 6/1996 | Wilkerson, Jr. | 248/125.9 X |
| 5,560,053 | | 10/1996 | Mills . | |
| 5,586,352 | | 12/1996 | O'Brien et al. . | |

FOREIGN PATENT DOCUMENTS

| | | |
|---|---|---|
| 69 04 720 | 7/1969 | (DE) . |
| 93 05 522 | 8/1993 | (DE) . |
| WO 82/02832 | 9/1982 | (WO) . |

* cited by examiner

*Primary Examiner*—Ramon O. Ramirez
*Assistant Examiner*—Tan Le
(74) *Attorney, Agent, or Firm*—Schiff Hardin & Waite

(57) ABSTRACT

An auxiliary device for aiding a bed-ridden or disabled patient to sit up in bed and leave the bed includes a holder, an arrangement for securing the holder onto a side of the bed, a post adjustably received in the holder, with an upper end of the post being provided with handles or grips for the patient. For securing the holder to the bed frame, U-shaped clamp elements are provided which can clamp onto a frame member of the bed frame or clips which hold the holder are secured by threaded fasteners.

8 Claims, 6 Drawing Sheets

2
24
25
25'
26
27
28
29
30
VIII

AUXILIARY DEVICE FOR BED-RIDDEN AND DISABLED PATIENTS

CROSS-REFERENCE TO RELATED APPLICATION

This application is a continuation of U.S. Ser. No. 08/841,459, filed Apr. 22, 1997, which issued as U.S. Pat. No. 6,039,293 on Mar. 21, 2000.

SUMMARY OF THE INVENTION

The present invention is directed to providing an auxiliary device for bed-ridden and disabled patients, which device is intended to serve the purpose of making it possible or easier for the patient to sit up in bed, leave the bed and subsequently support themselves adjacent to the bed.

To accomplish these goals, the invention is directed to an auxiliary device for disable, bed-ridden patients comprising a post having a grip extending toward the bed space as well as at least one grip extending parallel to a side of the bed, a holder for receiving the post and having means for locking the post therein, and means for fastening or mounting the holder to the side or edge of the bed.

The advantage of the motion aid, that can be attached to and, in turn, removed from a bed frame with few manipulations and has a movable upper part, is that it is adapted in height to the individual requirements of the patient. The motion or, respectively, uprighting aid can also be employed for motion therapy during rehabilitation.

Other advantages and features of the invention will be readily apparent from the following description of the preferred embodiments, the drawings and claims.

DESCRIPTION OF THE PREFERRED EMBODIMENTS

Figure 1:
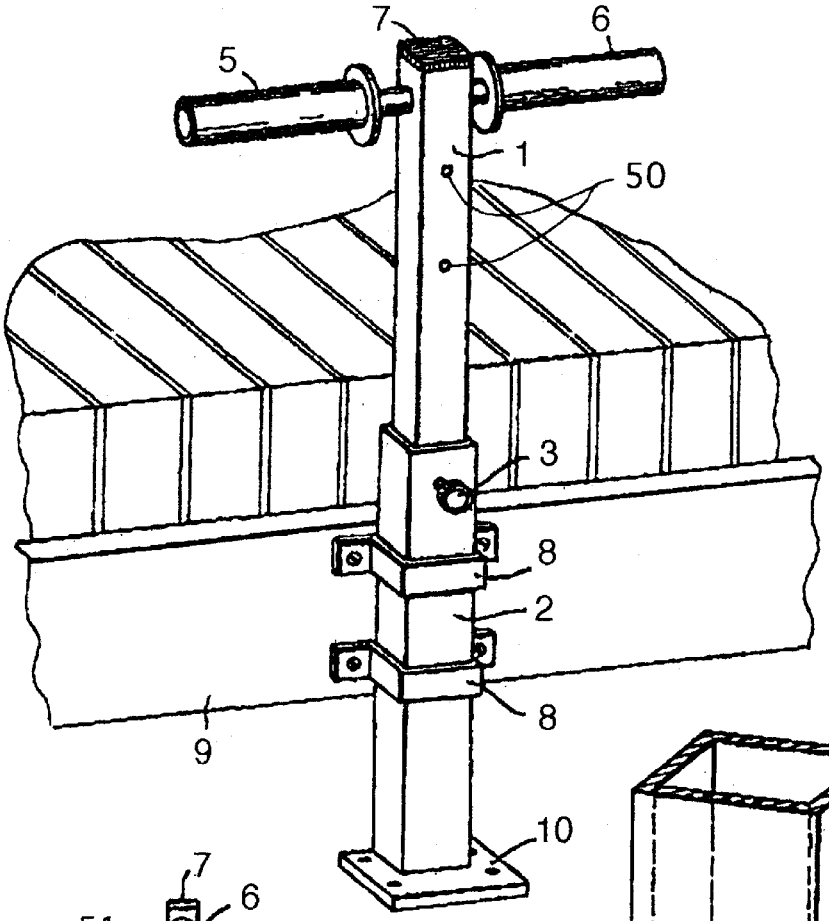
FIG. 1 is a perspective view of an embodiment of the auxiliary device for use with a stationary bed.

The principles of the present invention are particularly useful when incorporated in an auxiliary device, which is illustrated in FIG. 1, for making it easier for persons that are bed-ridden or disabled to sit up in bed, leave the bed and subsequently support themselves while standing along a side of the bed. As illustrated, the device is used with a stationary bed having a side board 9. The auxiliary device includes a post 1, which is preferably a quadrangular or four-sided post having a square cross section, which can be formed of a quadrangular pipe that can be inserted into a holder 2 that is composed of a quadrangular pipe and embraces the post with a form fit. The post can be locked in a position by a set screw 3.

Figure 2:
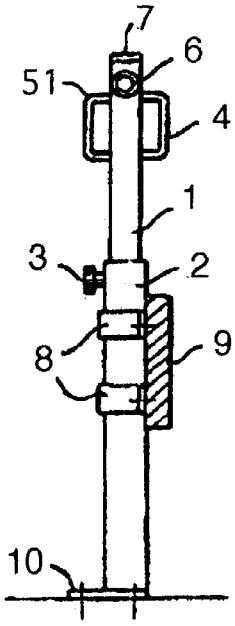
FIG. 2 is a side view of the auxiliary device of FIG. 1.

A holding grip 4 (FIG. 2) mainly serves as an uprighting aid for a patient and faces inward toward the bed space and is secured to an upper part of the post 1. In addition, grips 5 and 6, which are screwed into threaded bores of the post 7 and extend parallel to the side board 9 of the bed and help the patient execute turning movements or, respectively, lend the patient support when and after they have left the bed and are standing next to the device. Threaded bores 50 (FIG. 1), which receive a male thread of grips or a holder grip 51 (see FIG. 2), are provided on a side of the post 1 facing away from the bed. The upper end of the post has a covering 7.

The holder 2 is secured to a side board 9 of the bed frame with two clips or brackets 8, which are composed of flat bands that have angle bends and are secured to the side board 9 by screws. It is critical that the upper edge of the holder 2 is clearly lower than the upper side of the mattress so that the required operations at the patient or, respectively, the patient's bed are not impeded after the loosening of the set screw 3 and removal of the post 1. A holder 2 can be provided with a bottom plate 10 that lies on the floor, and the bottom plate can be screwed into the floor by screws extending through the four bores provided therein.

Figure 3:
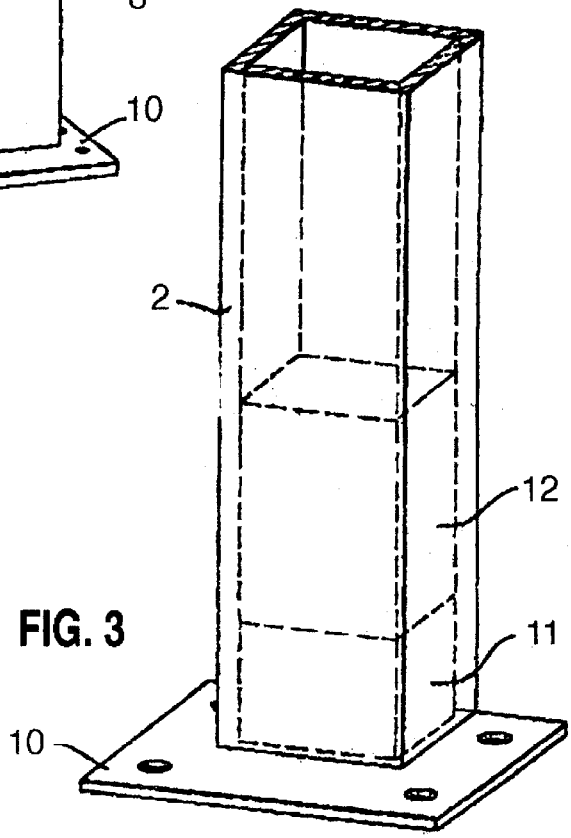
FIG. 3 is an enlarged perspective view of a base of the holder for the device of FIG. 1.

The set screw 3 is intended to prevent the post 1 that is inherently easily movable in the quadrangular pipe 2 forming the holder from unintentionally sliding up and is not suitable for supporting the full weight of the patient. Accordingly, as shown in FIG. 3, cuboid or four-sided inserts 11 or 12 are inserted in the holder 2 to limit the downward movement for the post 1 into the holder 2 and form means for selecting the height of support. On the basis of an appropriate selection of the length of the inserts and/or a plurality of these inserts, the height of the projecting post 1 can be matched to the individual demands of the patient. Instead of having the holder 2 connected to the bottom plate 10, it is expedient for an easier replacement of the inserts 11 or 12 to firmly join the bottom plate to the lowest insert that will define a minimum height for the upper post 1. After loosening of the fastening screws on the clip or brackets 8, the holder 2 can easily be pulled up a bit so that the loosely introduced inserts slide out of the holder 2 and can be replaced, as needed, by other inserts that can be inserted into the holder from below. With the lower insert 11 secured to the plate 10, this forms a plug for receiving the square tube forming the holder 2 with a telescopic or socket-like connection.

Figure 4:
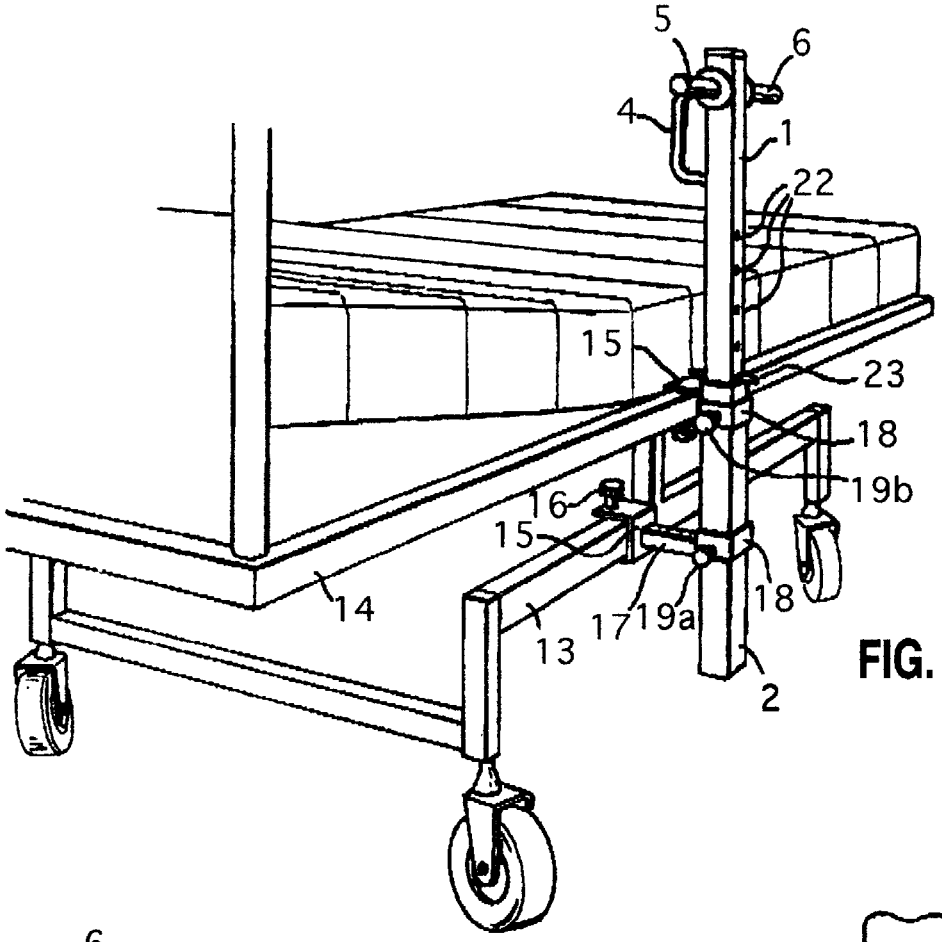
FIG. 4 is a perspective view of a second embodiment of the auxiliary device intended for movable beds.
Figure 5:
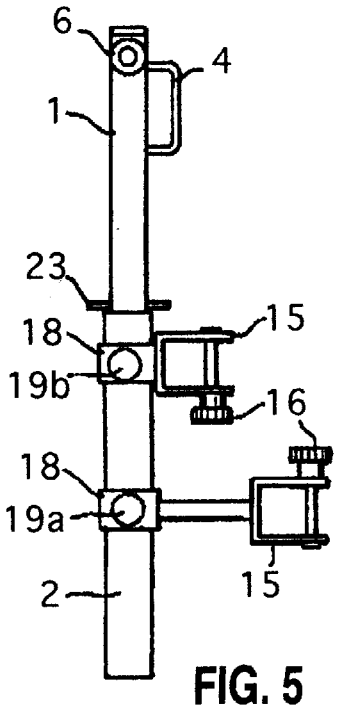
FIG. 5 is a side view of the auxiliary device of FIG. 4.
Figure 6:
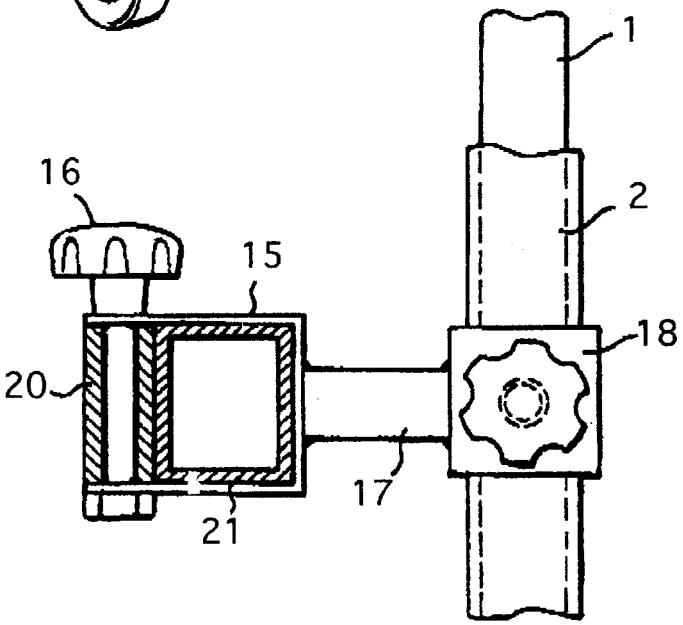
FIG. 6 is an enlarged cross sectional view through an anchoring for the holder of the device of FIG. 4 with portions in elevation for purposes of illustration.

A modified embodiment of the invention is illustrated in FIGS. 4 and 5, and is designed for movable beds which have a carriage frame 13 and a mattress support frame 14 arranged thereabove, which is standard in hospitals, clinics and nursing homes. The construction of the post 1 and the holder 2 essentially corresponds to that of FIGS. 1 and 2. Here, however, the holder cannot be supported directly on the floor, but must be firmly anchored to the metal frame 13 or, respectively 14. To this end, U-shaped fish plates or clamps 15 allocated to each frame are provided. The clamps 15 will embrace the respective frame 13 or 14 and are capable of being pressed thereagainst with a compression screw 16, which extends between the legs of the U-shaped clamp, as best illustrated in FIG. 6. The clamps are unreleasably connected to a flat band 18, which surrounds the holder 2, namely either directly or, when the carriage frame 13 is set back, by an appropriately long adapter 17 composed of a quadrangular or square pipe. In the flat band 18 allocated to the lower frame, there is provided at least one threaded bore for a set screw 19*a* to form a pressure contact with the holder 2, whereas two threaded bores are provided in the flat band allocated to the upper frame 14 on opposite sides thereto for the two set screws 19*b*, which are guided through the bores in the holder 2 and into pressure contact with the post 1. Like the set screw 3 in FIG. 2, the set screws 19*a* and 19*b* oppose the post 1 from sliding up inadvertently above all, however, and, given an appropriate dimensioning, they prevent the holder from moving relative to the firmly anchored flat band 18 when loaded with the full height of the patient.

As illustrated in FIG. 6, a tubular adapter or bushing 20 of an elastic material that has a bore for the screw 16 and loosely touches the frame 13 in an unstrained or uncompressed condition is arranged between the legs of the U-shaped clamp 15. The inside surfaces of the U-shaped clamp 15 are provided with an elastic layer 21 of, for example, plastic to protect the finish of the bed frame. Thus, when the screw 16 is threaded into the nut to clamp the U-shaped clamp 15 onto the frame, the bushing 20 is compressed and expands to form a grip with the frame member.

The post 1 comprises a plurality of cross bores 22 for the acceptance of a safety pin or fixing pin 23, with which the post is supported on an upper edge of the holder 2. When the upper edge of the holder is fixed in a position that is illustrated in FIG. 4, it projects only slightly beyond the upper edge of the mattress support frame 14.

As illustrated, the holder 2 of the device is mounted on the outside edges of the frames. However, by providing a shorter spacer 17, the holder can also be attached to the frame 14 on the inside of the frame member so that the post, when introduced into the holder, will move through the closest opening in the wire grid, which is usually provided for supporting the mattress, and, thus, the mattress is simply pushed slightly away by the presence of the post 1. With such an attachment of the holder 2 on the inside of the frame member 14, the bed can still be easily moved through doors and not have its width increased by the presence of the device.

Figures 7, 8, 9:
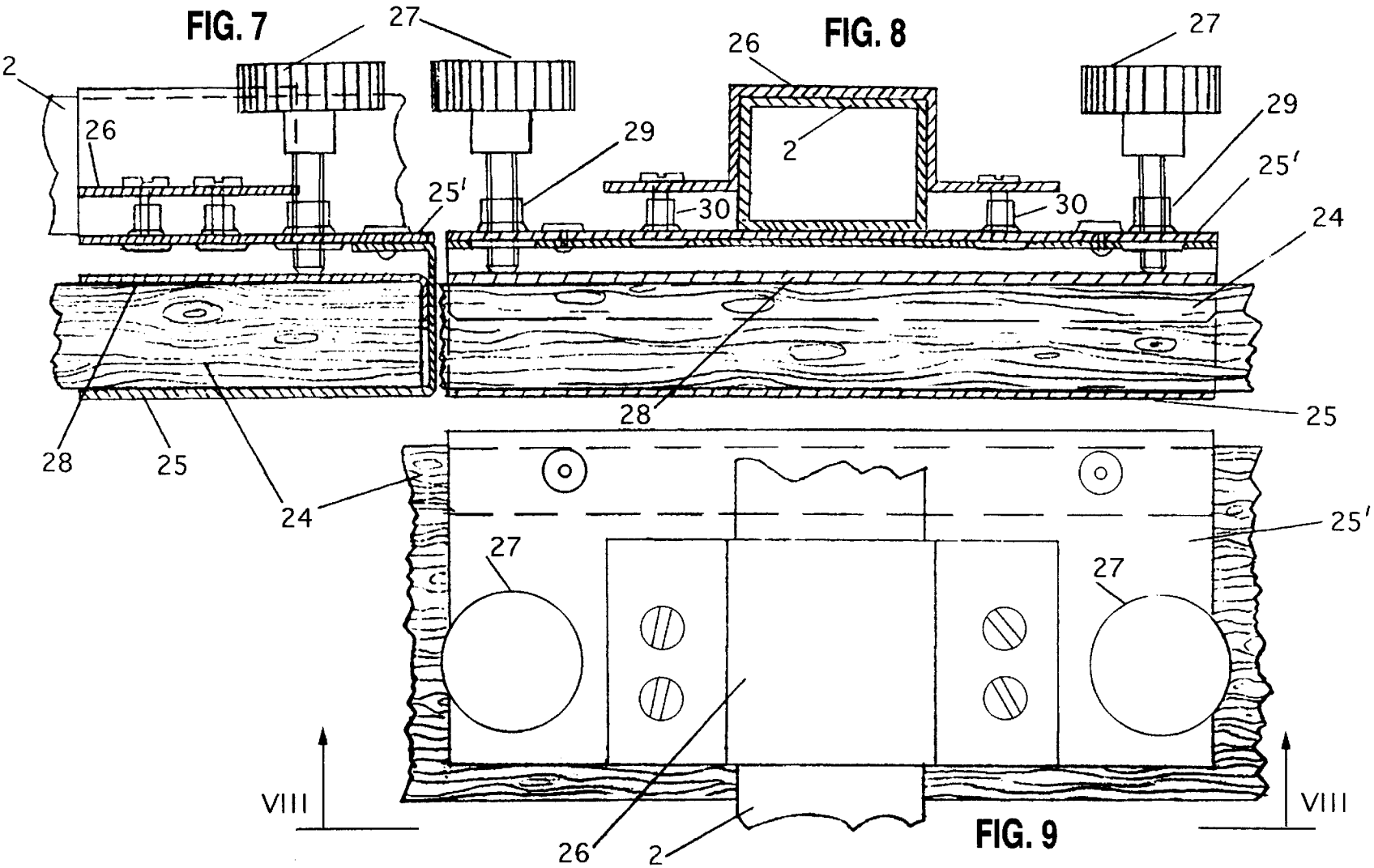
FIG. 7 is an end view of a modification of a fastening arrangement for securing the device of the present invention on a stationary bed.
FIG. 8 is a bottom view taken along the lines VIII–VIII of FIG. 9.
FIG. 9 is a side elevational view of the device of FIG. 7.
Figure 10:
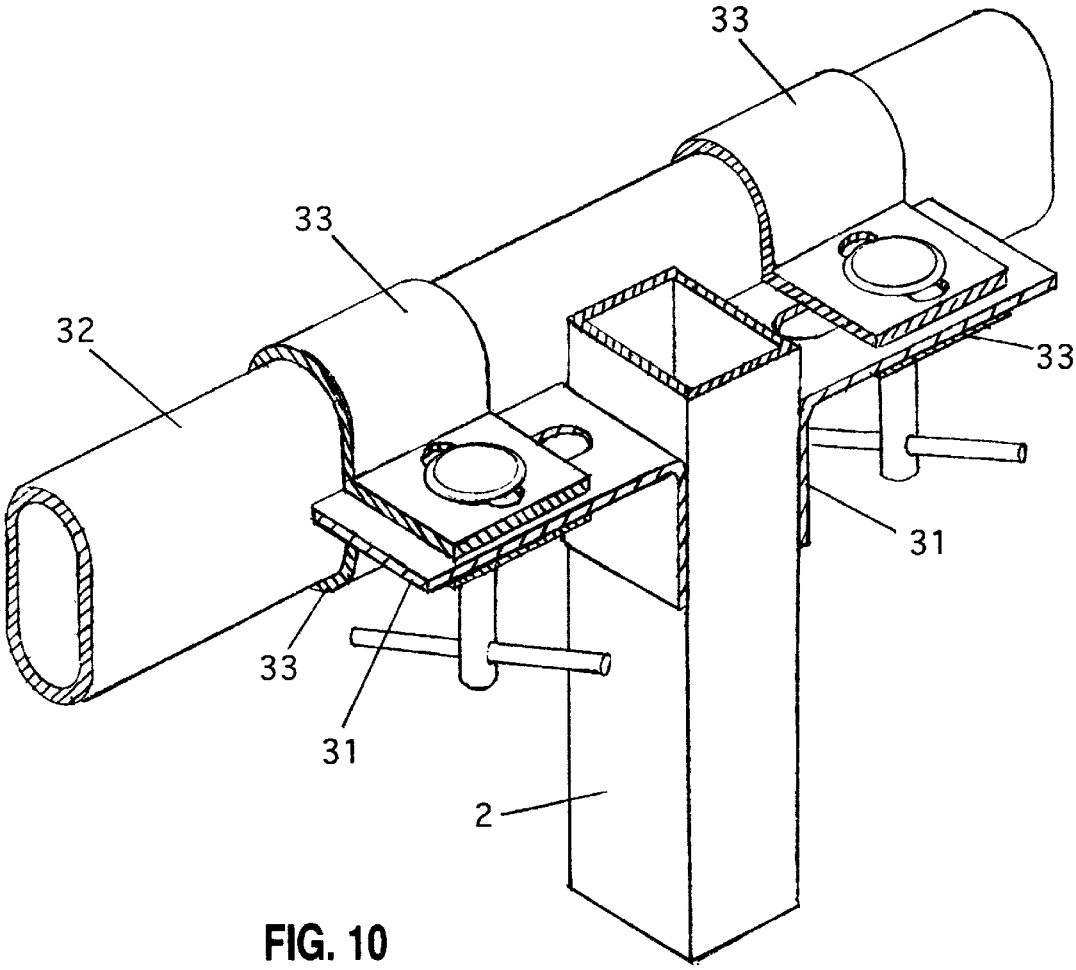
FIG. 10 is a perspective view of another embodiment for securing the holder to a bed frame.

A modification of the means for mounting or securing the post holder 2 on the side of a bed frame, such as a stationary bed, is illustrated in FIGS. 7–9. This mounting means includes two sheet metal parts 25 and 25', which are joined together by rivets to form a U-shaped member for mounting on a side board 24. The post holder 2 is secured to the sheet metal part 25 with a clip or bracket 26, which is held by four screws which are threaded into rivet nuts 30, which were provided in a sheet metal part 25'. Two additional rivet nuts 29 are also provided and are connected to an L-shaped pressure plate 28 for pressing this plate against the surface of the side board 24. Rivet nuts are known in and of themselves and serve the purpose of providing a thin-wall structural element with a nut with female threads. Rivet nuts can be installed with specific drawing tools, for example a hand tool which is sold under the trade name "GESIPA". The rivet nuts 29 and 30 are mounted in the sheet part 25' before the part 25' and the part 25 are joined together by rivets. The employment of the pressure plate 28 prevents damage or, respectively, dents in the side board 24 of the bed frame. The fastening means shown in FIGS. 1–3 also has the advantage that expensive welding work for reinforcing material for the nut threads can be dispensed with given a cost-saving lightweight structure. The parts 25 and 25' can also advantageously be composed of a plastic material. Given an appropriate, thorough reinforcement of the material, it would also be possible to replace the parts 25 and 25' with a single U-shaped part and to introduce the nut threads for the pressure and fastening screws directly into these parts.

In the bed frame, as shown in FIGS. 4–6, the frame members are formed of a quadrangular square cross section. However, if the bed frame is formed of a tubular member having an oval shape, such as shown by the profile frame member 32, a different structure clamp is required. Clamp members 33 are matched to the shape of the profile of the frame member 32 and engage an angle piece 31, which has been welded to the post holder 2. As illustrated, these are clamped onto the angle pieces by a threaded member and a pair of the clamp members 33 are provided.

When the movable bed, which is standard for clinics and care fields, has a quadrangular mattress frame member, a fastening means, which is composed of two U-shaped fish plates or clamps 34 connected to one another by a web, which clamps can be tightened against the frame by two compression screws 35, can be provided. An inside surface of this U-shaped clamp member 34 is provided with a protective layer 36. The post holder 2 is firmly connected to the connecting web between the two clamps 34, such as by welding. The holder is provided with a set screw, such as 37, for the post. A counter-nut 38 serves the purpose of securing the position of the set screw 37.

Figure 11:
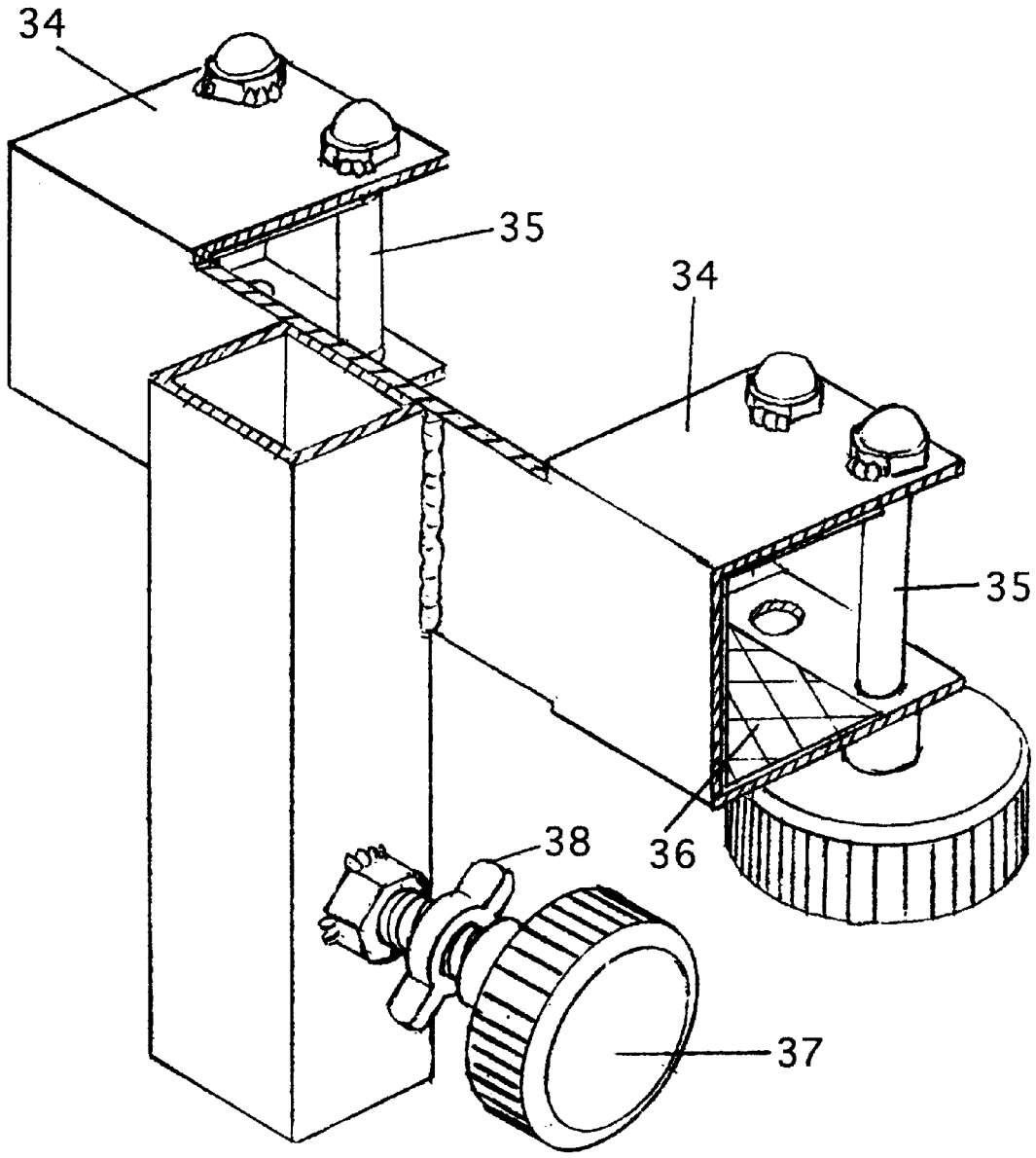
FIG. 11 is a perspective view of an additional modification for fastening the holder to a frame of a movable bed.
Figure 12:
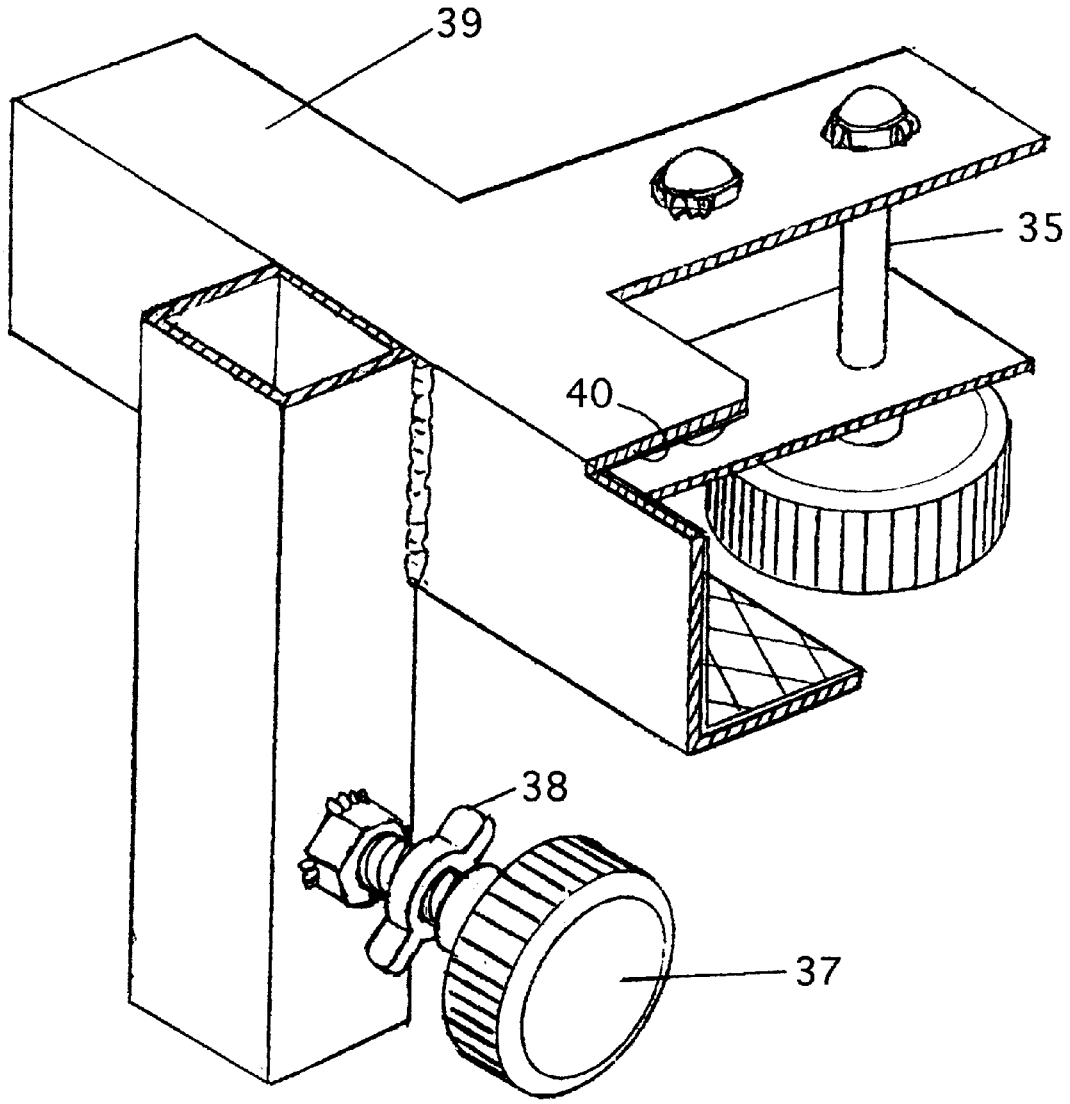
FIG. 12 is yet another modification for securing the holder to a frame of a movable bed.

Another modification of the mounting means, which is an especially low-outlay embodiment for movable beds that are preferably intended for quadrangular mattress frames that extend more into the inside of the bed, is illustrated in FIG. 12. In this embodiment, similar to the embodiment of FIG. 11, the post holder is merely secured to the mattress frame and is vertically adjusted with vertical movement of the frame. Only a single clamp member 39 is provided for embracing the mattress frame, wherein the legs of this clamp member are fashioned T-shaped, as can be seen in FIG. 12. An incision 40 is provided in the upper leg to allow the fastening device to be positioned closer to a raisable head part of the bed, and this is useful for a more comfortable raising of the patient.

Although various minor modifications may be suggested by those versed in the art, it should be understood that I wish to embody within the scope of the patent granted hereon all such modifications as reasonably and properly come within the scope of my contribution to the art.

I claim:

1. An auxiliary device for a bed to aid disabled, bedridden patients to move about a bed space of the bed, said bed having a frame with a pair of side boards, said device comprising a four-sided post having a grip at one end extending toward the bed space and two grips extending parallel to one of the side boards of the bed, said grips being rigidly mounted on said post, a holder composed of a quadrangular pipe for telescopically receiving a second end of the post in a form-fit with the grips extending above one end of the pipe, said holder having means for limiting an amount of insertion of the one end of the post into the holder and separate means for locking the post in the holder, and clamping means for mounting the holder directly to the one side board of the bed, the clamping means for mounting the holder comprising two clamps composed of flat band material bent with at least one angle connected to the holder, each clamp having a bore for receiving a fastening screw to screw the clamp on the one side board and said means for limiting including a cuboid insert resting on a floor surface and being introduced into the other end of the holder.

2. An auxiliary device according to claim 1, wherein the cuboid insert is connected to a flat plate and an additional insert rests on the cuboid insert and the inserts are received in said holder.

3. An auxiliary device according to claim 2, wherein the flat plate has bores for fastening screws to secure the plate to a floor.

4. An auxiliary device for a bed to aid disabled, bed-ridden patients to move about a bed space of the bed, said bed having a frame with a pair of side boards, said device comprising a four-sided post having a grip at one end extending toward the bed space and two grips extending parallel to one of the side boards of the bed, said grips being rigidly mounted on said post, a holder composed of a quadrangular pipe for telescopically receiving a second end of the post in a form-fit with the grips extending above one end of the pipe, said holder having means for limiting an amount of insertion of the one end of the post into the holder and separate means for locking the post in the holder, and clamping means for mounting the holder directly to the one side board of the bed, the clamping means including a U-shaped part having two leg portions, a clip for engaging the holder being mounted on an outside of one of the leg portions, a pressure plate received between the leg portions and threading members received in the one leg portion for urging the pressure plate toward the other leg portion to clamp the side board between the pressure plate and other leg portion.

5. An auxiliary device according to claim 4, wherein the means for limiting includes a four-sided insert resting on a floor surface and being introduced into the other end of the holder.

6. An auxiliary device according to claim 4, wherein the leg portions of the U-shaped part are sheet metal parts riveted to one another at a side facing away from the bed, the one leg portion being a planar sheet metal part having rivet nuts which are allocated to the thread members as well as fastening screws for the clip element.

7. An auxiliary device according to claim 4, wherein the U-shaped part is made of two plastic parts which are joined together by fastening elements.

8. An auxiliary device according to claim 4, wherein the surface of the U-shaped part and of the pressure plate lying against the side board are provided with an elastic protective layer.

* * * * *